US012041991B2

(12) United States Patent
Phillips

(10) Patent No.: US 12,041,991 B2
(45) Date of Patent: Jul. 23, 2024

(54) HAT SLEEVE

(71) Applicant: Anthony Lenard Phillips, Riviera Beach, FL (US)

(72) Inventor: Anthony Lenard Phillips, Riviera Beach, FL (US)

( * ) Notice: Subject to any disclaimer, the term of this patent is extended or adjusted under 35 U.S.C. 154(b) by 31 days.

(21) Appl. No.: 17/548,998

(22) Filed: Dec. 13, 2021

(65) Prior Publication Data

US 2022/0192295 A1 Jun. 23, 2022

Related U.S. Application Data

(60) Provisional application No. 63/128,369, filed on Dec. 21, 2020.

(51) Int. Cl.

| | |
|---|---|
| ***A42C 5/00*** | (2006.01) |
| ***A41D 20/00*** | (2006.01) |
| ***A41D 31/18*** | (2019.01) |

(52) U.S. Cl.

CPC ..... *A41D 20/00* (2013.01); *A41D 31/185* (2019.02)

(58) Field of Classification Search

CPC ..... A41D 20/00; A41D 31/185; A42C 5/00

See application file for complete search history.

(56) References Cited

U.S. PATENT DOCUMENTS

| | | | | | |
|---|---|---|---|---|---|
| 2,214,995 | A * | 9/1940 | Dorsey | A42B 1/22 | 2/183 |
| 5,590,422 | A * | 1/1997 | Henderson | A41D 20/00 | 132/273 |
| 10,061,350 | B2 * | 8/2018 | Magi | G06F 1/1652 | |
| 2014/0338103 | A1 * | 11/2014 | Tsai | A42C 5/00 | 2/244 |
| 2015/0164166 | A1 * | 6/2015 | Tsai | A42C 1/00 | 66/171 |
| 2016/0198830 | A1 * | 7/2016 | Tussey | A42B 1/049 | 2/183 |
| 2016/0213959 | A1 * | 7/2016 | Barklow | A41D 13/1107 | |

FOREIGN PATENT DOCUMENTS

| | | | | |
|---|---|---|---|---|
| GB | 2295767 A * | 6/1996 | A41D 23/00 | |
| GB | 2510132 A * | 7/2014 | A41D 23/00 | |

* cited by examiner

*Primary Examiner* — Tajash D Patel

(74) *Attorney, Agent, or Firm* — The Concept Law Group, PA; Scott D. Smiley; Scott M. Garrett

(57) ABSTRACT

The present invention provides a head sleeve device that comprises a body member made of Lycra Spandex fabric. The body member includes an interior passage that can be accessed through an opening positioned on the body member. The body member includes a flexible material attached near the opening; an inner layer having two opposite inner-layer free ends attached together; a tubular member that includes a malleable wire, an outer layer that includes two opposite outer-layer free ends forming the opening, a holder attached to the outer layer; and one or more D-rings attached to the outer layer.

9 Claims, 5 Drawing Sheets

HAT SLEEVE

FIELD OF THE INVENTION

The present invention relates to a head device worn on the head. More specifically, the present invention relates to a self-adjustable device that can be worn by users having a range of head circumferences.

BACKGROUND OF THE INVENTION

A self-adjustable device that can be worn by users is in demand. Many people use a hat for various purposes, and most hats are made of fabric that changes appearance when worn by the user.

Headbands or head wraps can be used with a hat for various purposes. Some people want to alter their overall look by wearing a headband over their hat, and others want to wear a headband over a hat simply to keep their head warm.

Still other people wear a headband over their hat for other purposes, whether to collect sweat from the head during physical exercise or simply to pull back hair. Headbands may also be used for decorative purposes.

Most headbands or head wraps tend to loosen and become dislodged after being worn over a hat or even during use. Some headbands also create pressure and pain on the user's head when they are fitted too tightly. Accordingly, there is a need to develop a device that can solve these problems.

The present invention is intended to address problems associated with and/or otherwise improve on conventional devices through the innovation of a head sleeve that is designed to provide a convenient and effective means of being worn on a hat without scarifying the aesthetic appearance of the hat and while incorporating other problem-solving features.

SUMMARY

In accordance with the present invention, a head sleeve device is provided. The head sleeve device comprises a body member that includes an interior passage that can be accessed through an opening positioned on the body member. The body member includes a flexible material attached near the opening; an inner layer having two opposite inner-layer free ends attached together; a tubular member that includes a malleable wire, an outer layer that includes two opposite outer-layer free ends forming the opening, a holder attached to the outer layer; and one or more D-rings attached to the outer layer.

The present invention can be made of Lycra Spandex fabric and can be form-fitting to dress hats and ball caps, so that the elastic stretch provided by the body member made of Lycra Spandex will serve as a hat band, adjusting to the wearer's head or hat size.

DETAIL DESCRIPTIONS OF THE INVENTION

All illustrations of the drawings are for the purpose of describing selected versions of the present invention and are not intended to limit the scope of the present invention.

Figure 1:
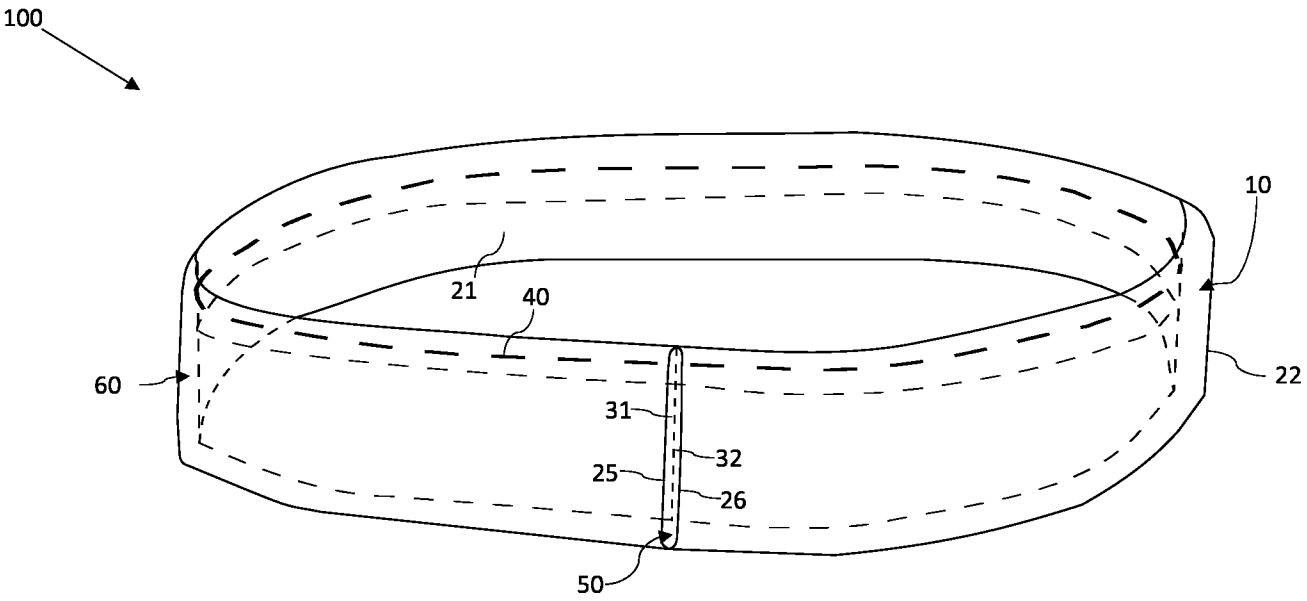
FIG. 1 is an illustration of one embodiment of the present invention.

As FIG. 1 shows, the present invention provides a head sleeve device 100 that comprises a body member 10.

Figure 2:
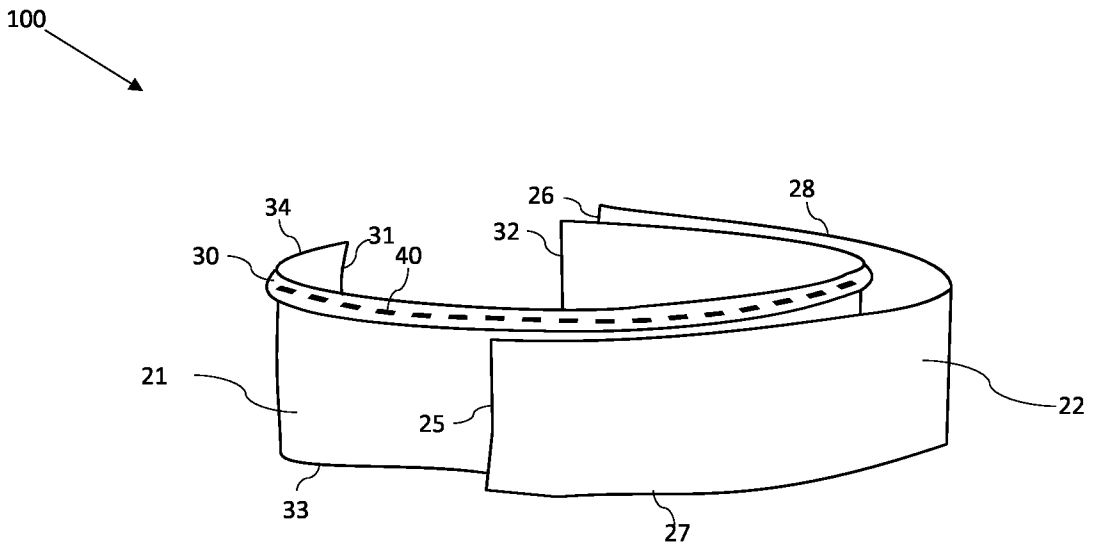
FIG. 2 is an illustration of one embodiment of an inner layer and an outer layer of the present invention.

The body member 10, as shown in FIG. 2, can include an inner layer 21 and an outer layer 22. The inner layer 21 can be an elongated inner rectangle with two inner longitudinal sides 33, 34 extending laterally between two inner-layer free ends 31, 32.

In one embodiment, the two inner-layer free ends 31, 32 can be attached together so that the inner layer 21 can form an inner loop.

The outer layer 22 can also include an elongated outer rectangle with two outer longitudinal sides 27, 28 extending laterally between two outer-layer free ends 25, 26.

In one embodiment, the two outer-layer free ends 25, 26 can be attached together so that the outer layer 22 can form an outer loop.

Figure 3:
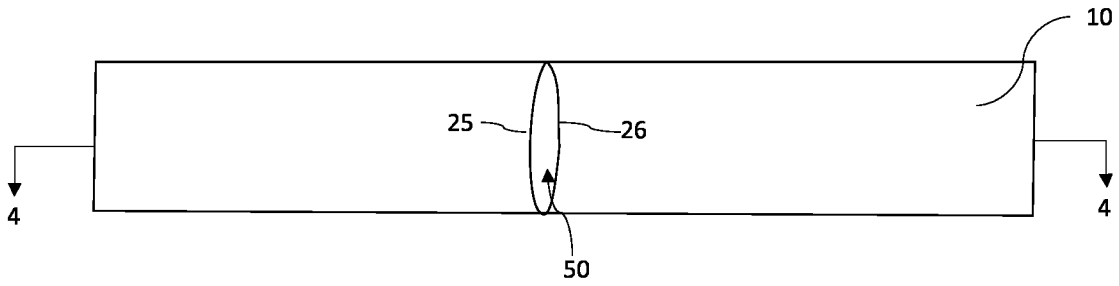
FIG. 3 is a front view of one embodiment of the present invention.
Figure 4:
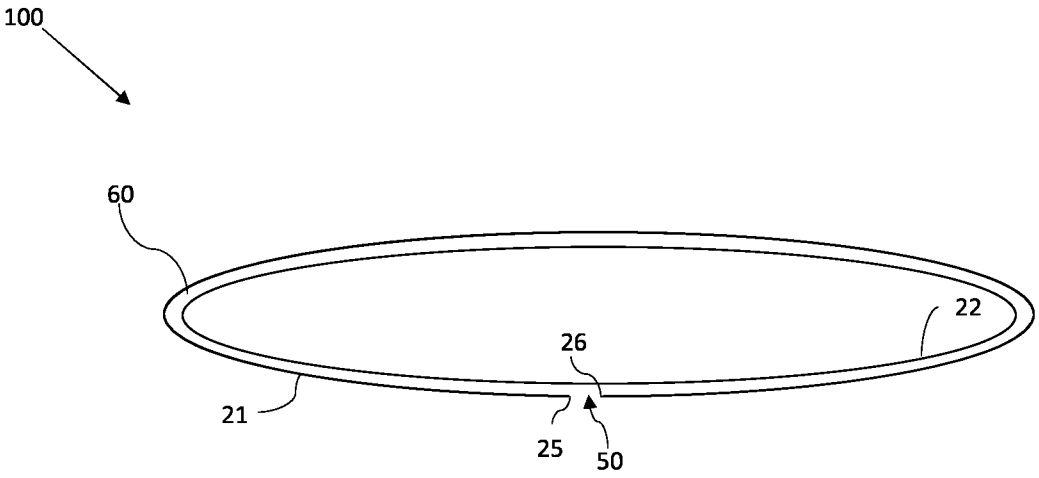
FIG. 4 is a cross-section taken along lines 4-4 of FIG. 3.

In one embodiment, the two inner longitudinal sides 33, 34 and the two outer longitudinal sides 27, 28 can be attached together to form a head sleeve device 100 of the present invention that can be generally annular in shape, as shown in FIG. 1, FIG. 3 and FIG. 4. In such embodiments, the two outer-layer free ends 25, 26 can provide an opening 50. The inner and outer layers 21, 22 can define an interior passage 60 that can be accessed through the opening 50 provided by the two outer-layer free ends 25, 26. The interior passage 60 can provide a case or container for carrying an item such as money or a credit card.

The body member 10 can be of any suitable shape and size, and made of any material, suitable for carrying the item.

The body member 10 near the opening 50 provided by the two outer-layer free ends 25, 26 may include a flexible material suitable for closing and opening the interior passage 60 using finger pressure, including but not limited to plastics.

The flexible material can be flexible enough to be squeezed by finger pressure but can also be rigid enough to maintain the shape of items put inside the interior passage 60 of the body member 10.

In some embodiments, the body member 10 may be configured in such a way that the user can squeeze the side areas of the opening 50 to open the body member 10. When the user stops squeezing the body member 10, it may snap shut, minimizing the chance of money or another item escaping.

The opening 50 may be expanded by exerting pressure on the side areas of the opening 50, thereby forcing the outer-layer free ends 25, 26 to bow away from each other. For example, when the body member 10 is in a flat closed position, two opposed outer-layer free ends 25, 26 may connect to each other to form a closed outer layer 22. The user can squeeze these side areas of the opening 50 toward each other to expand the opening 50 from its flattened position into a more tubular open position, then release the squeezing pressure to allow the opening 50 to snap back shut, minimizing the chance of inside items' (e.g., money, a credit card) escaping.

In some embodiments, the body member 10 may be easily flattened by the user to remove any inside air and placed in a closed and flat collapsed position (such that the passage 60 has reduced or no volume) that allows easy storage of the head sleeve device 100 of the present invention in a user's pocket, bag, or purse.

Figure 5:
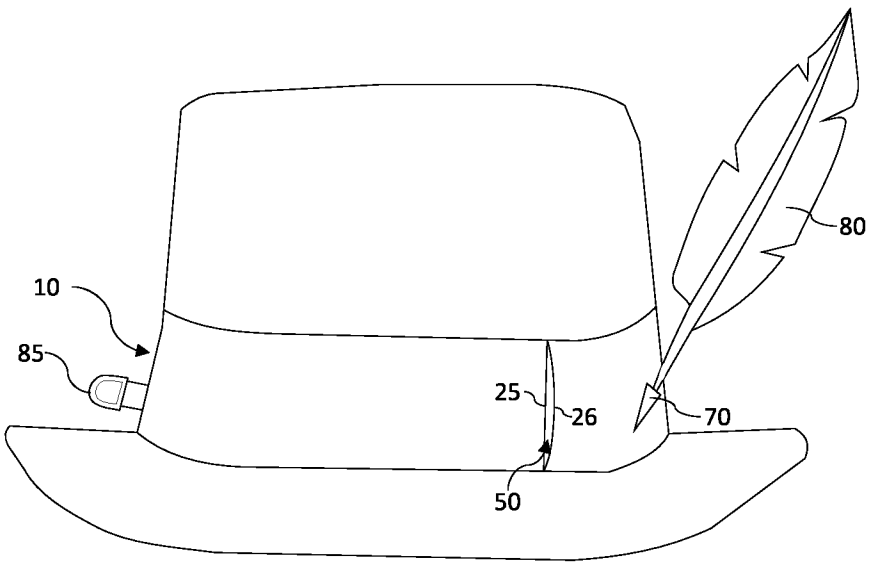
FIG. 5 is an illustration of one embodiment of the present invention installed on a hat.

The hat sleeve device 100 of the present invention can be worn over a hat to match a shirt, necktie, shoes, or the like. The hat sleeve device 100 of the present invention can be made of Lycra Spandex fabric and can be form-fitting to dress hats and ball caps, so that the elastic stretch provided by the body member made of Lycra Spandex will serve as a hat band, as shown in FIG. 5, adjusting to the wearer's head or hat size.

In some embodiments, the inner layer 21 may include a tubular member 30 of flexible material to help maintain selected shapes and resist wrinkles. Within the tubular member 30 is a malleable wire 40 of minimal elasticity, capable of being deformed and of retaining its new shape until further deformation by the user. The malleable wire 40 is of such length and general configuration as to fit within, conform to, and generally define an outer periphery of the generally oval configuration of the body member 10 throughout most of the length of that periphery. The tubular member 30 can be stitched adjacent the outer edge of the inner layer 21 so that the malleable wire 40 is held along the inner layer 21 periphery, in such a way as to slip within the tubular member 30 as deformation occurs.

In some embodiments, the outer layer 22 may include a holder 70 for a feather 80, for decorative purposes.

In some other embodiments, the outer layer 22 may include one or more D-rings 85 or other connectors known in the art to provide a mechanism for hanging the present invention on a wall.

Although the invention has been explained in relation to its preferred embodiment, it is to be understood that many other possible modifications and variations can be made without departing from the spirit and scope of the invention.

What is claimed is:

1. A head sleeve device comprising:

a body member having an interior passage that can be accessed through an opening positioned on the body member, wherein the body member is made of fabric and includes a flexible material attached near the opening;

an inner layer having two opposite inner-layer free ends attached together, and inner-layer longitudinal sides extending laterally between the inner-laver free ends:

a tubular member attached to the inner layer along one of the inner-layer longitudinal sides, the tubular member includes a malleable wire configured to fit within and define an outer periphery of the body member;

an outer layer having two opposite outer-layer free ends and outer-laver longitudinal sides extending laterally between the outer-layer free ends, the outer-layer longitudinal sides being attached to the inner-layer longitudinal sides thereby defining an interior passage between the inner layer and the outer laver, an opening formed between the outer-layer free ends that provides access to the interior passage, and wherein the flexible material is configured to open the opening when a pressure is exerted at the longitudinal sides at, the opening and to close the opening when the pressure is removed;

a holder attached to the outer laver; and one or more D-rings attached to the outer layer.

2. The head sleeve device of claim 1, wherein the fabric of the body member is an elastic fabric.

3. The head sleeve device of claim 1, wherein exerting pressure on opposite sides of the opening causes the outer-layer free ends to bow away from each other.

4. A head sleeve device, comprising:

a body member having an interior passage that can be accessed through an opening positioned on the body member, wherein the body member is made of fabric and includes an inner layer having two opposite inner-layer free ends attached together, and inner-layer longitudinal sides extending laterally between the inner-layer free ends;

a tubular member attached to the inner layer along one of the inner-layer longitudinal sides, the tubular member includes a malleable wire configured to fit within and define an outer periphery of the body member;

an outer layer having two opposite outer-layer free ends and outer-layer longitudinal sides extending laterally between the outer-layer free ends, the outer-layer longitudinal sides being attached to the inner-layer longitudinal sides thereby defining an interior passage between the inner layer and the outer layer, an opening formed between the outer-layer free ends that provides access to the interior passage; and a flexible material attached at the outer layer near the opening for closing and opening the outer-layer free ends to provide access to the interior passage.

5. A head sleeve device, comprising:

an inner of fabric in the shape of an elongated rectangle having inner-layer ends that are joined together, and longitudinal sides extending laterally between the inner-layer ends;

an outer layer of fabric in the shape of an elongated rectangle corresponding to the inner layer and having two opposite outer-layer free ends and outer-layer longitudinal sides extending laterally between the outer-layer free ends;

the outer-layer longitudinal sides being attached to the inner-layer longitudinal sides thereby defining an interior passage between the inner layer and the outer layer;

an opening formed between the outer-layer free ends, from one of the longitudinal sides to an opposite longitudinal side, and that provides access to the interior passage; and a flexible material attached at the outer layer at the opening for closing and opening the outer-layer free ends to provide access to the interior passage.

6. The head sleeve device of claim 5, wherein the fabric of the inner layer and the fabric of the outer layer is an elastic fabric.

7. The head sleeve device of claim 5, further comprising a tubular member attached to the inner layer along one of the inner-layer longitudinal sides, the tubular member includes a malleable wire configured to fit within and define an outer periphery of a body member comprised of the inner layer and the outer layer.

8. The head sleeve device of claim 5, further comprising a holder at the outer-layer configured to hold a feather.

9. The head sleeve device of claim 5, further comprising a D-ring attached to the outer layer.

* * * * *